United States Patent [19]

Kronenwetter et al.

[11] 4,055,271

[45] Oct. 25, 1977

[54] SHEET METAL CONTAINER

[75] Inventors: Howard W. Kronenwetter, Tarentum; Freddy R. Schultz, Lower Burrell, both of Pa.

[73] Assignee: Aluminum Company of America, Pittsburgh, Pa.

[21] Appl. No.: 698,587

[22] Filed: June 22, 1976

[51] Int. Cl.[2] ..... B65D 7/42

[52] U.S. Cl. ..... 220/64; 113/120 Y; 220/67; 220/77

[58] Field of Search ..... 220/66, 67, 77, 78, 220/79, 75, 64; 113/120 K, 120 V, 120 Z, 120 Y, 121 AB, 120 AA, 121 A, 121 C, 121 AB

[56] References Cited

U.S. PATENT DOCUMENTS

| | | | |
|---|---|---|---|
| 636,339 | 11/1899 | Hull | 113/120 Y |
| 657,000 | 8/1900 | McKim | 113/120 Y |
| 782,141 | 2/1905 | Kenny | 72/401 |
| 1,607,923 | 11/1926 | Sebell | 220/67 |
| 1,706,910 | 3/1929 | Wright et al. | 113/120 Y |
| 2,362,846 | 11/1944 | O'Brien | 220/67 |
| 2,382,378 | 8/1945 | Bloedorn | 220/67 |
| 2,412,528 | 12/1946 | Morrell | 220/64 |
| 2,424,188 | 7/1947 | Pearson | 220/75 |
| 3,151,767 | 10/1964 | Nakata | 220/77 |
| 3,152,717 | 10/1964 | Schwaiger | 220/64 |
| 3,367,533 | 2/1968 | Baker | 220/67 |
| 3,385,249 | 5/1968 | Czarnecki | 113/120 AA |
| 3,618,817 | 11/1971 | Troughton | 113/120 K |

*Primary Examiner*—William Price
*Assistant Examiner*—Allan N. Shoap
*Attorney, Agent, or Firm*—William J. O'Rourke, Jr.

[57] ABSTRACT

An improved sheet metal container and method of forming the same are provided in which the container comprises a body member and an end member wherein the body member is provided with a body flange extending generally radially outwardly at the end thereof, and the end member is provided with a wall which fits within the body member and an end flange extending generally radially outwardly at the end thereof rolled into a seam with the body flange. The body flange is curled at its terminal end against a coating provided on the metal surface of the body member and the end flange is curled at its terminal end against a coating provided on the metal surface of the end member to isolate the metals having different electrode potentials in order to resist galvanic corrosion.

3 Claims, 6 Drawing Figures

FIG. 1. FIG. 2. FIG. 3. FIG. 4.
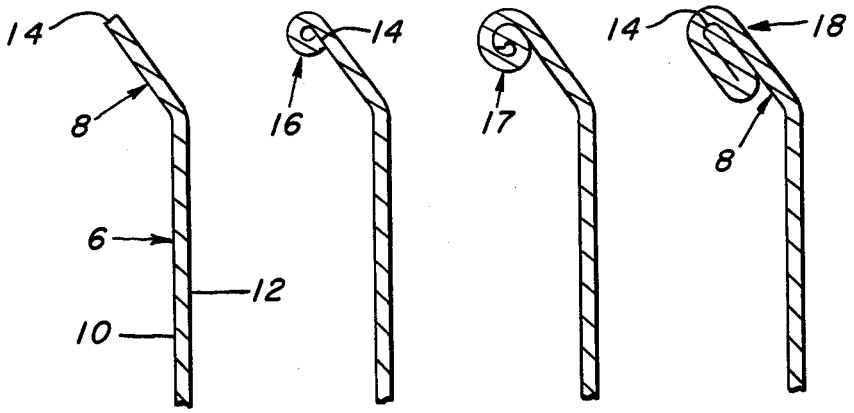
FIG. 5.
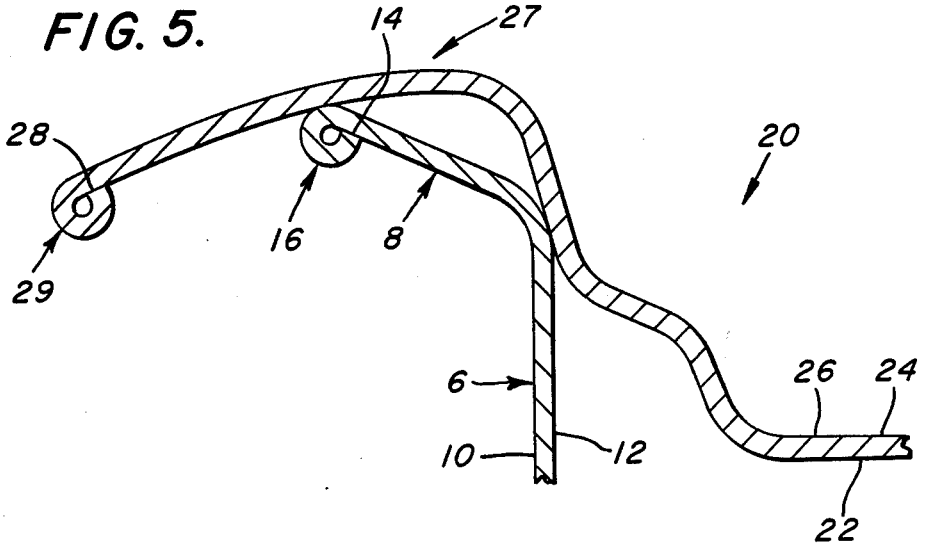
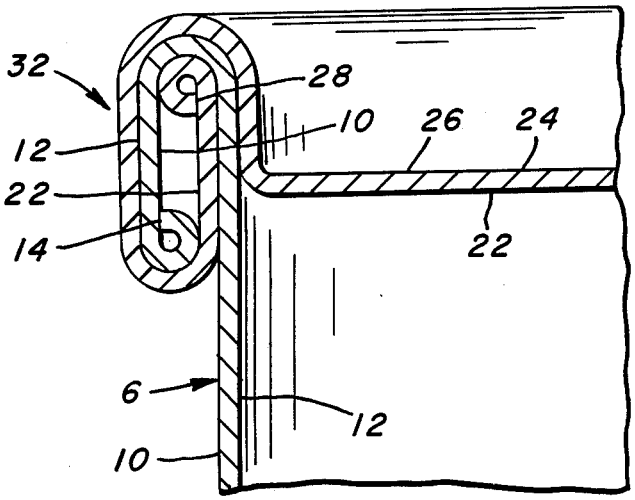
FIG. 6.

SHEET METAL CONTAINER

BACKGROUND OF THE INVENTION

1. Field of Invention

The present invention relates to a sheet metal container and more particularly to an improved container having sheet metal members with different electrode potentials isolated in order to resist galvanic corrosion.

2. Description of the Prior Art

A common starting workpiece for a formed sheet metal container is a blank severed from flat or coiled stock sheet metal. For economic reasons, it is common practice to protectively coat both sides of the flat stock sheet metal. This insures that both surfaces of the blanks will be coated after severance. An inherent deficiency in this practice is that the edges of the blank are not protectively coated.

Containers for foods and beverages must be protectively coated for a variety of reasons among which are considerations of taste, appearance and odor. Also, since containers may be constructed of metals having different electrode potentials, and since the contents could serve as an electrolyte it is often necessary to isolate the metals even at the exposed edges in order to resist galvanic corrosion. Examples of very corrosive foodstuffs include tomatoes, citrus juices, cherries and prunes.

Galvanic corrosion, or electrochemical corrosion, occurs when current flows between cathodic and anodic areas on metallic surfaces in a galvanic cell of two conductors having different electrode potentials in an electrolyte. Electrode potential refers to the ability of a conductor to corrode in a galvanic cell and has been used as a metallurgical research tool by measuring the potential against a 0.1 N calomel reference electrode in a standard $NaCl—H_2O_2$ solution of 53 gram per liter NaCl + 3 gram per liter $H_2O_2$ at 25° C. The electrode potentials of some metals and alloys are as follows:

| Metal | Potential |
|---|---|
| Magnesium | −1.73 |
| Zinc | −1.10 |
| Mild Steel | −0.58 |
| Lead | −0.55 |
| Tin | −0.49 |
| Copper | −0.20 |
| Stainless Steel (Series 300 Type 430) | −0.09 |
| Aluminum Solid Solutions or Constituents | |
| $Mg_2Al_3$ | −1.24 |
| 99.95 Al | −0.85 |
| $CuAl_2$ | −0.73 |
| $FeAl_3$ | −0.56 |

In a galvanic cell, i.e. a cell in which chemical change is the source of electrical energy, the anode is more electrically reactive than the cathode. This difference in potential causes current to flow from the cathode to the anode through the metal, and from the anode to the cathode through the electrolyte to complete the circuit. Where the current enters the electrolyte, metal ions go into solution causing corrosion of the anode.

In the manufacture of cans, it would be common practice to join a tin plated steel body to an easy-open aluminum can end if it were not for galvanic corrosion. If these metals are not isolated from each other, the aluminum will tend to act as a sacrificial anode in a galvanic cell and may be destroyed. Methods of preventing anodic action or galvanic corrosion at the seam have been disclosed in the prior art, including for example U.S. Pat. No. 3,439,641. The present solutions include inserting a plastisol sealant in the seam and dip coating the flanges in a sealant bath prior to seaming in order to isolate the exposed metallic edges from each other. Individually coating the edges of each container blank is sometimes effective, however, it is a time consuming and thus expensive operation.

The prior art pertaining to sheet metal containers is replete with examples of seams and methods of forming seams. Some of the prior art patents disclose lapping, bending and folding of the terminal end of a sheet metal flange prior to rolling a seam, but none of these methods appear to provide resistance to galvanic corrosion. For example, O'Brien U.S. Pat. No. 2,362,846 discloses bending the flange back upon itself prior to rolling the seam to create a bulge in the seam in order to facilitate cutting the outer wall. Also, Bloedorn U.S. Pat. No. 2,382,378 discloses a hem at the end of the body of a pry-off container which provides a lock shoulder in order to engage a bead in the container cover in metal-to-metal contact. Pearson U.S. Pat. No. 2,424,188 pertains to forming a sideseam in a sheet metal can body by having one side edge portion lapped in order to avoid the exposure of raw metal on the inner side of the can.

Accordingly, an economical and effective improvement is required to assure that metals having different electrode potential are isolated after they are seamed together in order that galvanic corrosion is resisted.

SUMMARY OF THE INVENTION

This invention may be summarized as providing an improved sheet metal container comprising a body member and an end member isolated from one another. The body member has a body flange extending generally radially outwardly at the end thereof. The end member has a wall which fits within the body member and an end flange extending generally radially outwardly at the end thereof rolled into a seam with the body flange. The body flange is curled at its terminal end against a coating provided on the metal surface of the body member and the end flange is curled at its terminal end against a coating provided on the metal surface of the end member and rolled into a seam to isolate the metals having different electrode potentials thus resisting galvanic corrosion.

Among the advantages of the subject invention is the provision of a new and improved bimetallic sheet metal container comprised of body and end members having beaded terminal ends to resist galvanic corrosion.

It follows that an object of this invention is the elimination of the requirement of coating the exposed metal edges of the body and end members of a container to resist galvanic corrosion by isolating the edges of metals having different electrode potentials.

It is another object of this invention to provide a method of isolating a metallic can end from a metallic can body having different electrode potential by simply and economically curling the terminal ends of the body and end members closely against their respective surfaces to form a bead, multiple fold or roll to provide a structure which resists galvanic corrosion without the need for protectively coating the exposed metal edges of the body and end members.

The above and other objects and advantages of this invention will be more fully understood and appreciated with reference to the following detailed description and the drawings appended hereto.

BRIEF DESCRIPTION OF THE DRAWINGS

FIG. 1 is a partial cross sectional view of a container body blank.

FIG. 2 is a partial cross sectional view of a first embodiment illustrating a container body blank with a bead formed at the end thereof.

FIG. 3 is a partial cross sectional view of a second embodiment illustrating a container body blank with a roll formed at the end thereof.

FIG. 4 is a partial cross sectional view of a third embodiment illustrating a container body blank with a multiple fold formed at the end thereof.

FIG. 5 is a cross sectional view of a top portion of a container illustrating an end member received in a body member prior to rolling an end flange and a body flange into a double seam.

FIG. 6 is a cross sectional view of a top portion of a container illustrating a double seam of this invention.

DESCRIPTION OF THE PREFERRED EMBODIMENTS

Referring particularly to the drawings, FIG. 1 illustrates a cross sectional view of a portion of a tubular container body member 6 after it has been formed from protectively coated flat stock sheet metal. The body member 6 has a body flange 8 extending generally radially outwardly, transverse to the longitudinal axis at the end thereof. Exterior and interior surfaces 10 and 12 respectively are protectively coated but the severed edge surface 14 is not coated.

The sheet metal from which the container members are formed is typically coated on both sides with a solvent-based organic coating. The sheet is heated to a sufficiently high temperature to evaporate the solvent and cure the coating. A typical solvent-based organic coating includes the epoxy phenolic coatings. Other laminated or film coatings are provided by coating sheet metal with a material selected from the group consisting of polyester, polyurethane, polypropylene, polyvinyl chloride and polyvinylidene chloride.

In order to insure that the bare metal edge surface 14 of the body member 6 does not come in contact with metal having a different electrode potential when rolled therewith into a seam, the terminal end of the body flange 8 is curled to form a bead 16 as shown in FIG. 2. The inside radius of the bead is preferably from 1.5 to 5 times the sheet thickness. The bead 16 extends continuously around the periphery of the body member 6. As further illustrated in FIG. 2, the entire metal edge surface 14 completely engages the protectively coated exterior surface 10. It should be understood by those skilled in the art that edge surface 14 could alternatively be beaded against interior surface 12 or that the terminal end of the body member 6 could be rolled as shown in FIG. 3, or provided with multiple folds 18 as shown in FIG. 4, such that edge surface 14 is completely surrounded by similar metal. Regardless of how the edge surface 14 is formed, the preferred embodiments of this invention require that the bare metal edge surface 14 be isolated from metal having different electrode potential when a seam is subsequently rolled with a metal container end.

One advantage of the preferred bead 16 over the roll 17 or the multiple fold 18 is that less metal is required to form the bead 16. Another advantage is that the subsequent seam can be more thoroughly compressed when a bead 16 is formed rather than a roll 17 or a multiple fold 18. Compressing the seam is common practice in the canning industry to make the container more compact which facilitates packaging and provides the container with added joint strength.

FIG. 5 shows a container end member 20 punched and formed from protectively coated flat or coated stock sheet metal having interior and exterior surfaces 22 and 24 respectively protectively coated (not shown). The end member 20 is provided with a wall 26 which fits inside the body member 6. An end flange 27 extending generally radially outwardly from the wall 26 is generally parallel to the body flange 8 of the body member 6. The terminal end of the end flange 27, having a bare metal edge surface 28, is closely curled to form a bead 29 which may be similar to the bead 16 on the body flange 8. It should be understood that the edge surface 28 on the end member 20 may be isolated by the alternative means of this invention discussed above for the isolation of edge surface 14 on the body member 6, including rolling and multiple folding.

In forming a double seam 32, as shown in FIG. 6, the beaded end flange 27 is first folded around the bead 16 at the end of the body flange 8. The fold of beaded end flange 27 continues until the bead 29 comes in contact with the exterior surface 10 of the body member 6 near the base of the body flange 8. Then the body flange 8, with the end flange 27 wrapped tightly therearound, is folded downwardly and outwardly with respect to the container body member 6 until the exterior surface 24 of the end flange 30 is in direct contact with the exterior surface 10 of the body member 6. The double seam may be flattened by applying pressure on both sides of the seam around the periphery of the container. The finished double seam 32, as illustrated in FIG. 6, further has the exposed edge surfaces 14 and 28 in direct abutment with respective protectively coated surfaces 10 and 22 in such a manner that if the seam 32 is flattened laterally, the direction of the compression force is perpendicular to the edge surfaces 14 and 28. Therefore, the exposed metal edge surfaces 14 and 28 do not become dislodged upon compression, but rather are further driven into engagement with the coated surfaces 10 and 22 which may cause the edge surfaces 14 and 28 to penetrate the coating thereby creating an even more effective seal around the raw edges 14 and 28 to further insure that galvanic corrosion is resisted. If the exposed metal edge surface 14 or 28 penetrates the adjacent protective coat in the formation of the bead or during compression of the formed seam, the resulting contact would be between similar metals so galvanic corrosion would not be a problem.

A preferred double seam 32 of this invention illustrated in cross section in FIG. 6 shows the bead at the terminal end of the can end 20 in direct overhead relationship to the adjacently disposed bead at the terminal end of the container body 6 seamed therewith. The exposed metal edge surface 28 of the can end 20 is completely engaged with the coated inside surface 22 of the can end 20, and the exposed metal edge surface 14 of the container body 6 is completely engaged with the coated outside surface 10 of the container body 6. The portion of these coated surfaces 10 and 22 located at the interior of the double seam 32 are substantially parallel to and facing each other between the beads around the periphery of the container.

In a preferred embodiment, this invention is employed in the manufacture of conventional sheet metal containers. The body member 6 is punched and formed from tin plated steel stock, and the end portion 20 is punched and formed from an aluminum alloy stock. Common Aluminum Association alloys used in accordance with this invention include 1100, 3003, 5052, 5082, 5086 and 5154. Prior to the punching operation, the sheet metal stock is protectively coated. Coatings can be, for example, a film or an organic coating or laminated coatings with film on one side and an organic coating on the other.

Sheet metal containers are typically, though not necessarily, of the cylindrical shape and range from approximately 2 to 6 inches in diameter and 1 to 9 inches in height. For a conventional sheet metal container having a sheet thickness of approximately 0.003 to 0.018 inches, the width dimension of a sheet metal container body blank, should be increased preferably by approximately 0.095 inches to allow for beading in order to retain the original container height. All other dimensions may remain the same. It should be apparent to those skilled in the art that this invention is readily adapted for drawn containers as well as seamed containers.

As an example of a preferred embodiment of this invention, a cylindrical sheet metal container was assembled which had a 2 11/16 inch diameter and a 4 inch height. The starting workpiece was a container body blank from flat stock 55 pound tin plate having an electrode potential of approximately −0.50. The flat stock tin plate was coated on one side with an enamel and the other side with a lacquer. The edges of the blanked container body were not coated. The body blank had a length of 8.388 inches and a thickness of 0.010 inch. The width of the body blank was increased from a standard width of 4.105 inches to 4.200 inches. The additional width of 0.095 was provided to curl the terminal end of the body blank into a bead along the entire length such that the uncoated tin plate edge was in direct contact with the protectively coated surface. After the cylindrical container is formed, solder seamed along the side, and a flange is provided upwardly and outwardly of the longitudinal axis around the periphery of the formed container, the terminal end of the body blank is curled.

A generally circular easy-open aluminum can end having a thickness of 0.010 inch was punched from flat stock aluminum base magnesium alloy 5052 (2.5% Mg, 0.25% Cr) in extra hard H 19 temper. This can end has an electrode potential of approximately −1.25. The aluminum alloy sheet was coated with an epoxy urea resin on the outside surface and thermosetting vinyl resin on the inside surface prior to punching which left the edge surfaces of the can end uncoated after punching. The radius of the punched can end did not have to be increased to provide additional metal for the curl, rather the seam formed with the container body utilizes less metal length. After the punched easy-open can end was flanged upwardly and outwardly of the longitudinal axis, the periphery of the circular can end was curled into a bead such that the uncoated aluminum edge was in direct contact with the protectively coated surface of the can end, such as that illustrated in FIG. 2.

The unflanged circular wall of the can end having a diameter of 2 11/16 inches was received into the cylindrical container body. The beaded flange of the can end was tightly wrapped around the beaded flange on the container body to form a conventional double seam. The seam was then compressed in the direction of the longitudinal axis. One terminal of a volt-ohm milliammeter was connected to the can end and the other terminal was connected to the container body to test if current would flow through the dissimilar metals at the seam. No current registered which indicated that galvanic corrosion would be resisted when these metals having different electrode potentials are joined according to this invention.

Whereas the particular embodiments of this invention have been described above for purposes of illustration, it will be apparent to those skilled in the art that numerous variations of the details may be made without departing from the invention, including for example the formation of single or triple end seams, or the formation of side seams joining metal sheets having different electrode potentials.

What is claimed is:

1. A sheet metal container comprising:

a body member with interior and exterior surfaces protectively coated and the edge surfaces uncoated, having a body flange extending generally radially outwardly of the longitudinal axis of the container at the end thereof, the terminal end of said body flange being curled such that the entire uncoated edge surface is disposed inside the curl, and at least a portion of the interior surface of the curled body flange is butting against the exterior metal surface of the body member, and an end member having a different electrode potential than said body member with interior and exterior surfaces protectively coated and the edge surfaces uncoated, having a wall fitting within the body member and an end flange extending generally radially outwardly of the longitudinal axis of the container at the end thereof, the terminal end of said end flange being curled such that the entire uncoated edge surface is disposed inside the curl, and at least a portion of the exterior surface of the curled end flange is butting against the interior metal surface of the end member, said curled end flange subsequently rolled into a double seam with the curled body flange.

2. A sheet metal container as set forth in claim 1 wherein the body member is tin plate and the end member is aluminum.

3. A method of fabricating a corrosion resistant sheet metal container comprising:

curling a terminal end portion of a radially outwardly extending attachment flange on the top of a protectively coated cylindrical body member outwardly and downwardly such that an uncoated terminal edge surface thereof is entirely disposed inside the curl and at least a portion of the interior surface of the curled body flange is butting against the exterior surface of the body flange, curling the end portion of a peripheral flange of a protectively coated end member adapted to close the top end of said body member such that an uncoated terminal edge surface of said flange is entirely disposed inside the curl and at least a portion of the exterior surface of the curled end flange is butting against the interior surface of the end flange, and after forming the curls on the body member and the end member, seaming said end member on said body member by positioning the end member as the top end of said body member with the peripheral flange on the end member overlying the attachment flange on the body member and wrapping said flanges downwardly and inwardly together.

* * * * *